United States Patent [19]

Draper et al.

[11] Patent Number: 4,566,608

[45] Date of Patent: Jan. 28, 1986

[54] SYSTEM FOR CONVERTING STACK ACCESS NEWSPAPER VENDING MACHINES AND THE LIKE TO APPARATUS FOR DISPENSING PRODUCTS ONE AT A TIME

[75] Inventors: Reed T. Draper; Kenneth J. Pol, both of Saginaw, Mich.

[73] Assignee: Draper Technologies, Inc., Saginaw, Mich.

[21] Appl. No.: 635,664

[22] Filed: Jul. 30, 1984

Related U.S. Application Data

[63] Continuation-in-part of Ser. No. 613,641, May 24, 1984.

[51] Int. Cl.[4] ..... G07F 11/14

[52] U.S. Cl. ..... 221/229; 221/232

[58] Field of Search ..... 221/228, 229, 232, 249, 221/210, 227, 240, 248, 213, 214; 194/59, 51, 65

[56] References Cited

U.S. PATENT DOCUMENTS 3,831,809 8/1974 Knickerbocker ..... 221/227

4,418,836 12/1983 Christian ..... 221/232 X 4,501,379 2/1985 Halone et al. ..... 221/229 X

*Primary Examiner*—Stanley H. Tollberg

*Attorney, Agent, or Firm*—Learman & McCulloch

[57] ABSTRACT

A coin operated newspaper and like article vending system for dispensing articles on a one-at-a-time basis wherein a housing forms a cabinet for containing newspapers and like articles to be vended, a door is hinged on one side of the cabinet, a coin operated lock mechanism releasably locks the door to the cabinet, a partition is incorporated with the housing as a wall thereof situated behind the door and provides a dispensing slot behind the door for passing one article at a time, an elevator assures the delivery of newspapers successively to a location opposite the dispensing slot, a newspaper dispensing element is actuable to engage and move the newspaper partly out the opening, linkage mechanism connects the door and dispensing element to move the newspaper at least partly out of the opening when the door is moved and mechanism delays the return of the dispensing element to full dispensing position pending locking of the door.

22 Claims, 12 Drawing Figures

SYSTEM FOR CONVERTING STACK ACCESS NEWSPAPER VENDING MACHINES AND THE LIKE TO APPARATUS FOR DISPENSING PRODUCTS ONE AT A TIME

It is a continuation-in-part of our application Ser. No. 613,641, filed May 24, 1984, the disclosure of which is incorporated herein by reference.

BACKGROUND OF THE INVENTION

This invention is directed to the conversion of coin operated vending machinery in which the unlatching of a side access door, via insertion of the proper coins in a coin operated latch mechanism, provides access to an entire stack of newspapers. As indicated in that application, the newspaper vending machine believed to be in widest use today is the one disclosed in U.S. Pat. No. 3,174,608, in which the newspapers are statically supported in horizontal disposition in a generally vertical stack and the coin controlled access door is opened to permit the customer to remove a newspaper from the top of the stack. Of course, once access is obtained, the customer has the option of removing one newspaper or the entire stack. Considerable difficulty is now being encountered with vending machines of this type, which depend upon the honesty or goodwill of the people using them, because of the increasing variety of money saving coupons which are currently provided in newspaper advertisements.

While various one-at-a-time dispensing machines have been proposed, as exemplified in the patents mentioned in our co-pending parent application, no one has, as yet, to our knowledge, perfected a conversion mechanism which permits the continued use of the many thousands of full access vending machines which already are in use throughout this country and abroad.

SUMMARY OF THE INVENTION

A principal object of the present invention is to provide mechanism which converts a stack access vending machine to a machine which dispenses only a single article, and does so in an economical manner which makes it worthwhile to retain the vending machines already in the market place, rather than replace them with new machinery.

Another object of the invention is to provide a machine of this character which does not require the installation of an operating handle or other device, but uniquely uses the motive power of the existing access door to operate a newspaper dispensing member to move one of the newspapers in the stack out to a position in which it is accessible when the door is opened, and to control the return of the dispensing member.

Still, another object of the invention is to provide a vending machine of the character indicated which has the capability of dispensing articles of variant thickness, and does so in an efficient, reliable, and trouble-free manner.

Still, another object of the invention is to provide a relatively vandal-proof vending machine, which may deliver other appropriate products as well as newspapers.

Another important object of the invention is to design a vending machine which cannot be recycled in the sense of pushing the door almost to closed position, and then moving the door to open position again to dispense a second newspaper.

The system which will be described uses the power of the opening access door to deliver one end of the newspaper out a vending slot which is located behind the access door. The system is unaffected when the customer pulls the newspaper the rest of the way out of the slot, and the door must be relatched before a second newspaper can be dispensed.

Other objects and advantages of the invention will be pointed out specifically, or will become apparent from the following description, when it is considered in conjunction with the appended claims and the accompanying drawings.

IN THE DRAWINGS

Figure 1:
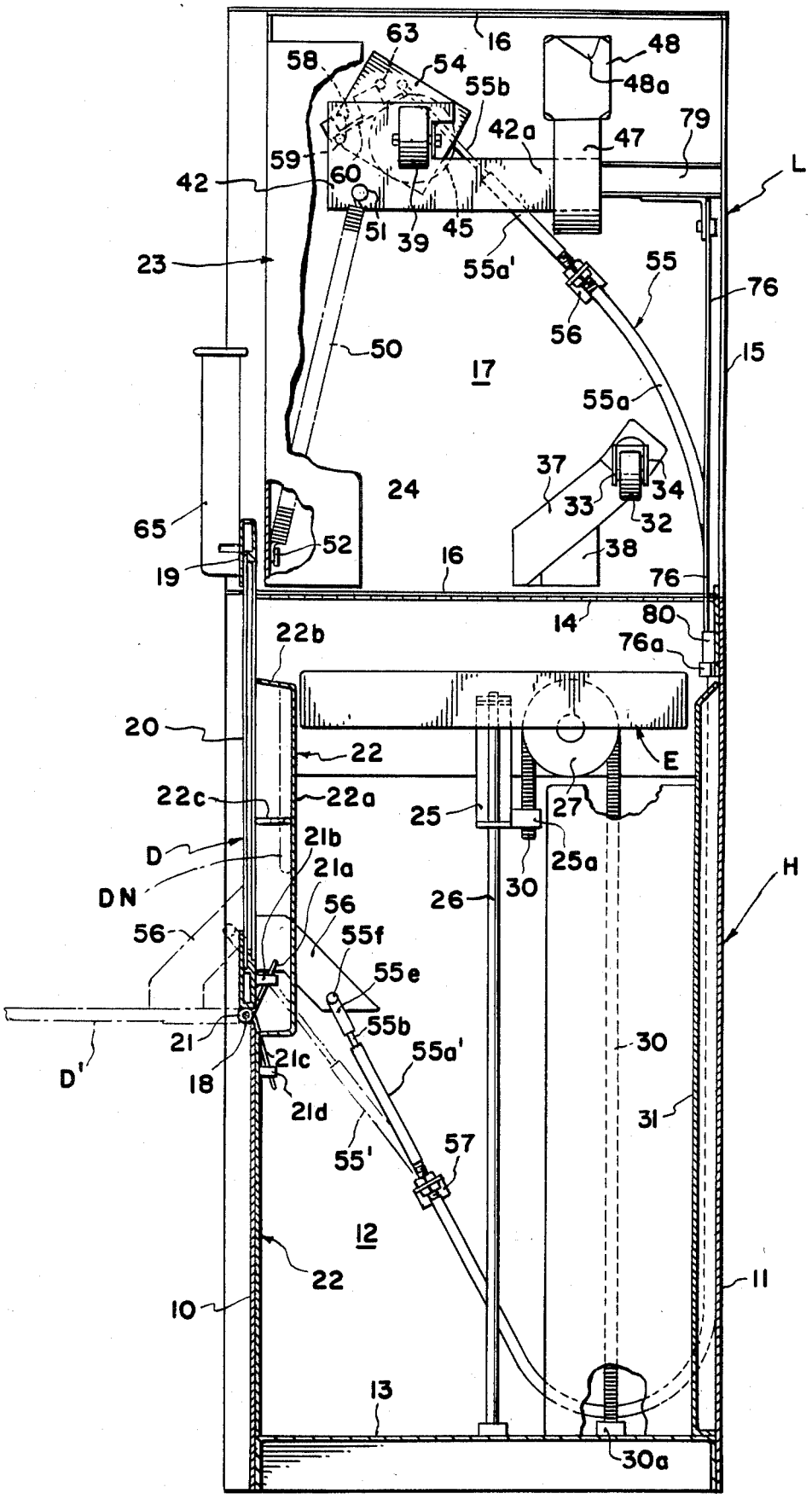
FIG. 1 is a sectional, side elevational view showing a top lid or cover for the vending machine swung to "up" position in order to illustrate various parts of the dispensing mechanism which are supported by the cover, the side door being shown in the "swung-down" position in chain lines.
Figure 2:
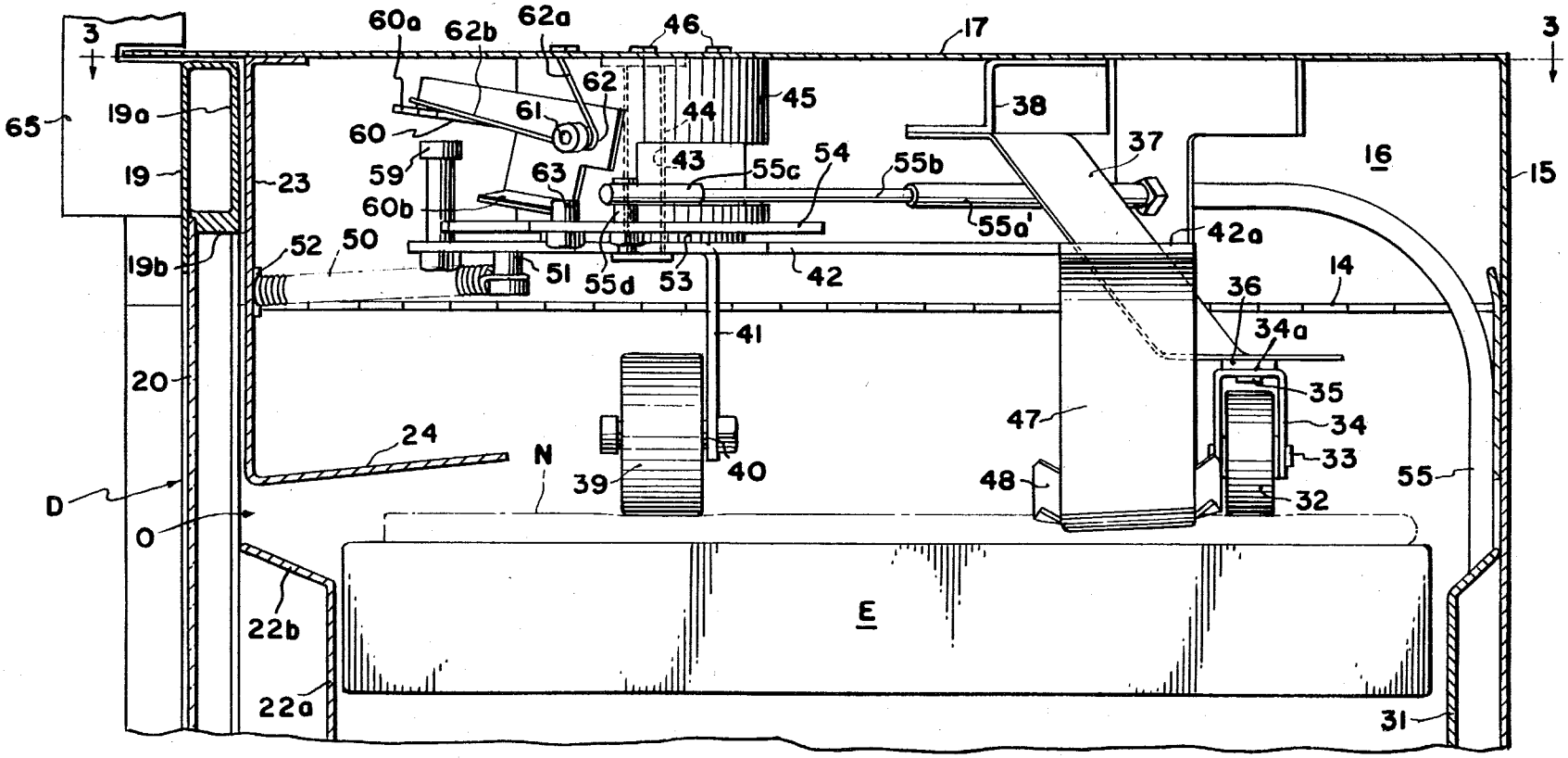
FIG. 2 is a similar fragmentary side elevational view on an enlarged scale, with the cover however being shown in the "swung-down" position, and, for the sake of convenience, only a single newspaper being shown on the stack supporting elevator platform.
Figure 3:
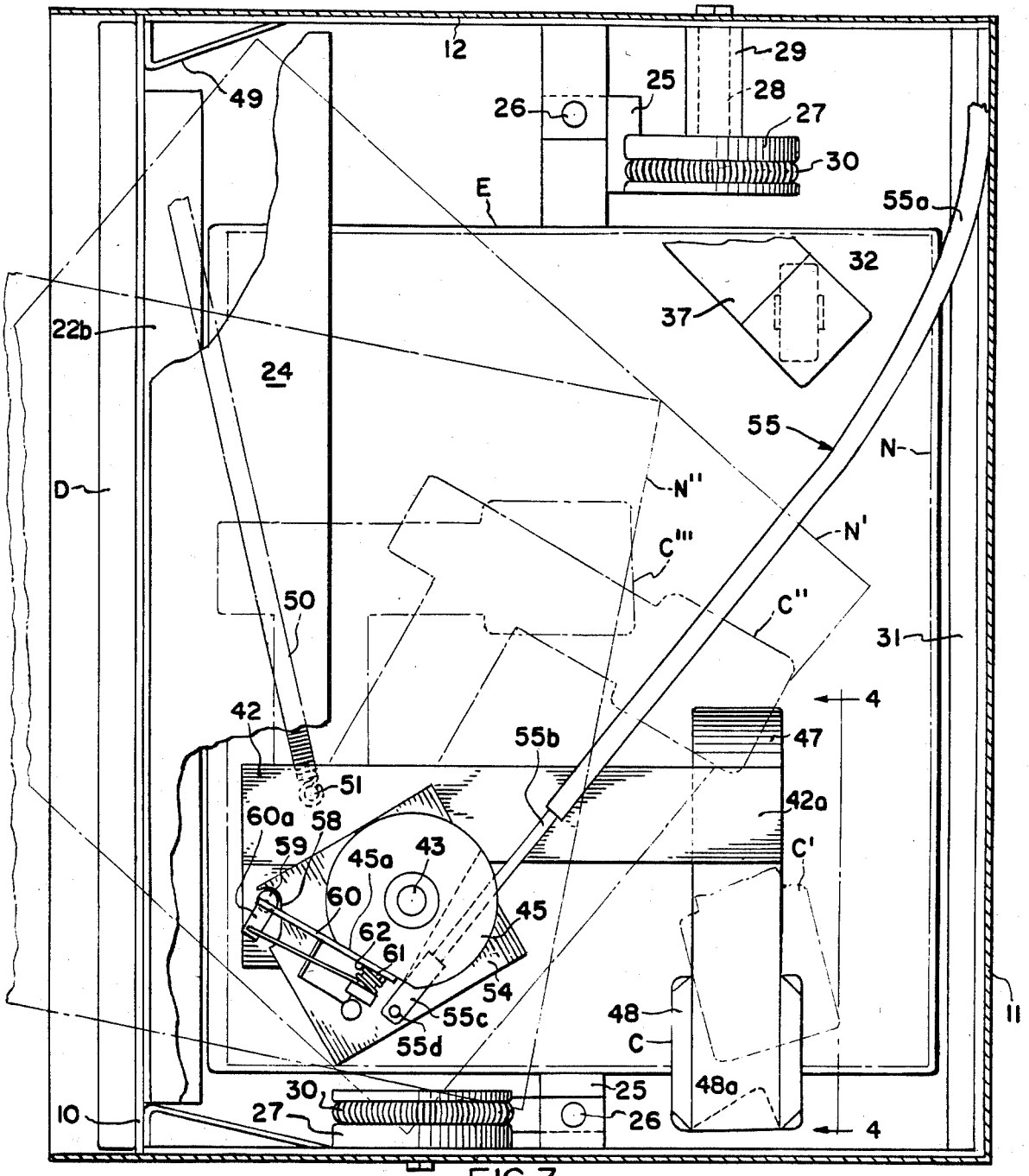
FIG. 3 is a top, sectional plan view, taken on the line 3—3 of FIG. 2, with the chain lines indicating advanced positions of the newspaper being dispensed and the claw which assists in moving the newspaper out the vending slot.

Referring now more particularly to the accompanying drawings, and in the first instance to FIGS. 1–3, it is to be understood that the mechanism which is to be described includes conversion mechanism for converting a vending machine in which there is free access to the stack of newspapers to a vending machine in which a single newspaper is dispensed with opening of the access door presently included in free access vending machines.

Typical vending machines of this character which are to be converted are disclosed in U.S. Pat. Nos. 3,265,177 and 4,106,609. Such vending machines comprise a rectilinear housing H with front and rear walls 10 and 11, side walls 12, and a bottom wall 13. The open upper end of the housing H is closed by a lid or cover L which is hinged as at 14 to one of the side walls 12. Cover L, as shown, is provided with a rear wall 15, side walls 16, and a top wall 17.

Hingedly connected to the front wall 10 at 18, is the usual access door, generally designated D, which comprises an outer frame 19 mounting a centrally disposed transparent plate 20. The frame 19 comprises tubular elements with inner walls 19*a* and marginal walls 19*b* which, in the conventional manner, provide a space S behind the transparent panel 20 within which a "display" newspaper DN may be displayed. Torsion springs 21, with a leg 21*a* trapped by door bracket 21*b*, and a leg 21*c* trapped by a housing bracket 21*d*, have sufficient power to return door D to the closed position.

Previously, the stack of newspapers simply rested on a shelf and the entire stack could be removed once the door D was unlocked and swung outwardly to the D′ position shown in FIG. 1. In the conversion process, a panel 22 is secured to the front wall 10 and has an inset portion 22*a* which extends upwardly to cover most of the access opening formerly available when the door D was swung to the D′ position. It is to this wall portion 22*a* that the display newspaper DN is releasably secured as by a U-shaped retaining wire 23 secured to wall 22*a*. As in the normal operation of such vending machines, when all of the newspapers have been dispensed from the stack S, the remaining newspaper DN can be taken by the last user of the vending machine.

It is to be observed that the panel wall portion 22*a* terminates in a top wall 22*b* (FIG. 2) spaced downwardly from the upper end of the door D, when the door D is in closed position. Secured to cover top 17 is a front upper wall panel 23 having an inwardly extending lower wall 24, which, together with the wall 22*b*, provides a newspaper dispensing opening O of such size as to permit the dispensing of single newspapers of varying thickness (in the daily to Sunday size) without permitting hand access through the opening O to someone who is attempting to remove more than a single newspaper.

Also to be mounted within the vending machine housing, during the conversion process, is an elevator platform E for supporting the stack S of newspapers which formerly was supported on the housing bottom wall. As shown in the earlier described embodiment of the invention illustrated in our U.S. application Ser. No. 613,641, the elevator E includes dependent clevis members 25 which are mounted for vertical travel along fixed guide rods 26 secured at each side of the housing H. At each side of the housing H, (see FIG. 3) a pulley 27, rotatably mounted on a shaft 28 journaled in a bearing 29, is provided for supporting a coil spring 30 which is secured to a lug portion 25*a* on each of the members 25. At its other end, each coil spring 30, which is trained around one of the pulleys 27, is secured to a mount 30*a* fixed to the platform 13. As indicated earlier, the purpose of springs 30 is to exert a uniform pressure on the elevator E to constantly urge it upwardly and keep the topmost newspaper N in the stack in dispensable position opposite opening O.

In order to confine the stack S of newspapers, and keep them in a position of vertical alignment, a back guide plate 31 is fixed to the housing wall 11. Also tending to maintain the alignment of the stack of newspapers N, and to hold the one corner of the topmost newspaper from raising, is a roller 32, rotatably mounted on a pin 33 supported by a clevis 34 which itself is mounted for rotation above a vertically extending pin 35. The clevis 34 has an upper web 34*a*, rotatably recieved against a support pad 36 carried by a resilient leaf spring member 37 which extends angularly from a bracket 38 fixed to cover top wall 17. Roller 32 thus can swivel when the newspaper N is being dispensed.

Provided to engage the diagonally opposite corner of the topmost newspaper N (see FIG. 3) in the stack S, is a roller 39, mounted for rotation on a pin 40 supported by a leg 41 which depends from a claw mounting dispensing arm or plate 42. The arm 42 is fixed to a pin 43 which is mounted for pivotal movement in an opening 44, provided in a fitting 45 fixed to the top wall 17 of cover L by bolts 46. The arm 42 is provided with an extending portion 42*a* to which a generally C-shaped leaf spring 47 is secured, as perhaps best illustrated in FIG. 4. The resilient leaf spring 47 has a newspaper engaging claw 48 secured on its free end as shown. Claw 48 is formed with a laterally extending hook portion 48*a*, having a beveled terminal edge 48*b*, such that the hook 48*a* can engage between the ends of the separate folded sections x of the newspaper, which are open in the sense that the hook 48*a* can be moved between them.

It is to be understood that the roller 39 functions as a fulcrum when the claw 48 is swung in the manner illustrated in the chain lines in FIG. 3 outwardly through substantially a 90° arc to a position in which its one end edge extends out opening O and can be grasped by a customer.

Advanced positions of the newspaper, as it it being swung outwardly, are shown at N′ and N″ and advanced positions of the claw C are shown at C′, C″, and C‴. Guides 49 may be provided on the side walls 12. So that they will not engage with the paper and in any way affect the return of the mechanism, the corners of claw plate 48 are bent upwardly as shown at 48*c*.

While, as will become apparent, arm 42 is moved in the dispensing operation by the act of moving the door D to open position, and is also returned by the closing of door D, return spring 50 is also provided for a purpose to be later described. The return spring 50 is fixedly connected to the arm 42 at 51, and fixedly connected to the plate 23 at 52.

Figure 7:
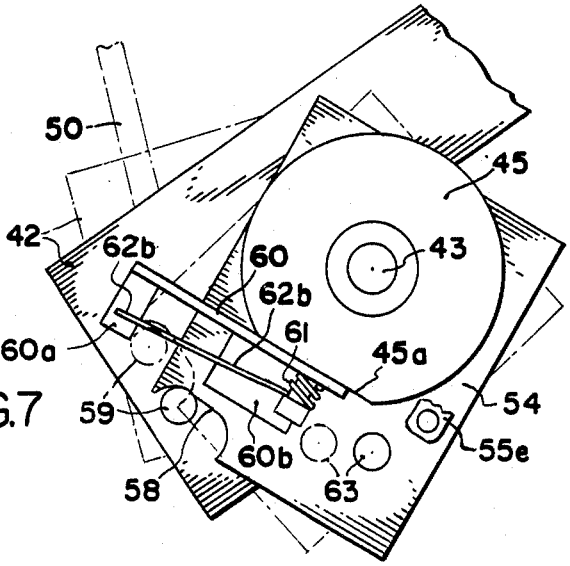
FIG. 7 is an enlarged, top plan view showing relative positions of the cable driven plate and the dispensing claw mounting plate at a time when the access door is being returned toward locked position, the chain lines indicating an advanced position of the parts taken on the line 7—7 of FIG. 8.
Figure 9:
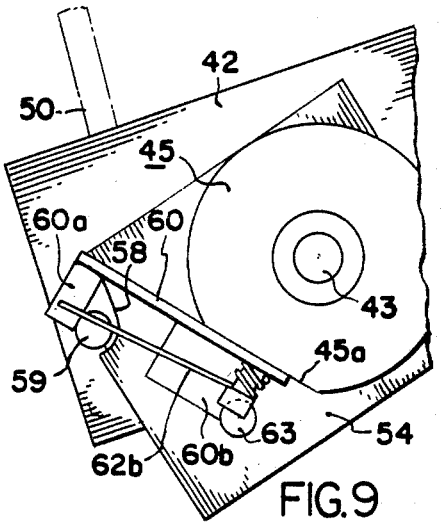
FIG. 9 is a similar plan view, but showing a different relative position of the cable driven plate and the claw mounting plate, and illustrating the time delay slot which keeps the dispensing claw in the FIG. 6 position until the access door is again locked in closed position.

Mounted for pivotal movement on pin 43, and separated from the plate 42 by a bearing 53, is a drive plate 54 which is connected by a cable assembly, generally designated 55, to the access door D. Cable assembly 55 includes an outer sheath member 55*a* with end fittings 55*a*′. A cable 55*b* passing through member 55*a* and fittings 55*a*′ is mounted for movement when door D is swung opened and returned. The sheath 55*a* can be adjustably secured by a bracket 56 to the cover top wall 17, as shown in FIG. 1, and to a bracket 57 secured to the one side wall 12. A fitting 55*c* fixed to cable 55*b* is pinned to plate 54 at 55*d*, and, at its opposite end, cable 55*b* has a fitting 55*e* is pinned as at 55*f* to an angular bracket 56 which is fixed to door D and extends inwardly therefrom. When door D is swung outwardly, cable 55*b* swings the plate 54 in a counterclockwise direction in FIG. 3. Provided in plate 54 (see FIGS. 7 and 9) is a curvilinear recess 58 which receives and traps a pin 59 which extends upwardly from plate 42. Thus, when plate 54 is swung counterclockwisely during the dispensing operation, the pin 59 will also cause the plate 42 and dispensing claw C to be driven counterclockwisely about pivot 43.

After the dispensing operation has taken place and the topmost newspaper N has been pulled from the stack by the customer, door D is swung upwardly which causes cable 55*b* to swing plate 54 in the return, clockwise direction. At the same time spring 50 is returning plate 42 in a clockwise direction, so that the plates 42 and 54 move in unison.

Figure 8:
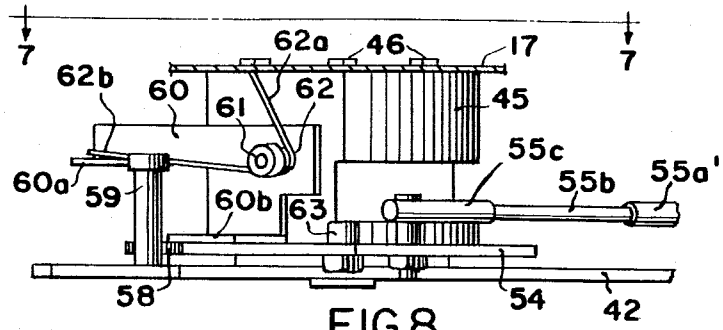
FIG. 8 is a fragmentary, side elevational view thereof.

Provided on a flatted side 45*a* of fitting 45 is a latch member 60, shown particularly in FIGS. 3 and 8, which is mounted on the face 45*a* by a pivot pin 61 for movement in a vertical plane between the positions shown in FIG. 8 and FIG. 2. A torsion spring 62, provided on pin 61, has a vertically upwardly extending arm 62*a* which extends into engagement with the top wall 17 of cover L. It also has a laterally extending arm 62*b* which extends to overlie a projecting leg 60*a* provided on the plate 60, which is at the level of the top of pin 59, when the parts are in the normal FIG. 8 position.

The spring arm 62*b* normally tends to force the leg 60*a* to the FIG. 8 position, but, as will presently be described, the plate 60 can be forced upwardly to the FIG. 2 position. Provided on the plate 54 to cam the plate 60 upwardly, is a cam pin 63 which, in its path of movement, is adapted to engage a projecting extension 60*b* provided on plate 60. The manner in which these parts cooperate to provide a lost motion operation, and a delay for claw 48 in its return to dispensing position, will presently be described.

Figure 10:
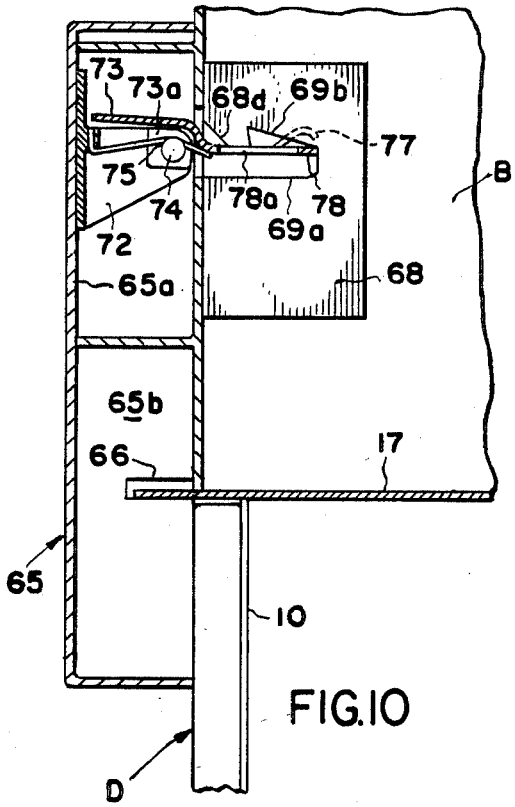
FIG. 10 is a fragmentary, enlarged, sectional, side elevational view illustrating the position of the access door locking parts when the door is in fully closed position.
Figure 11:
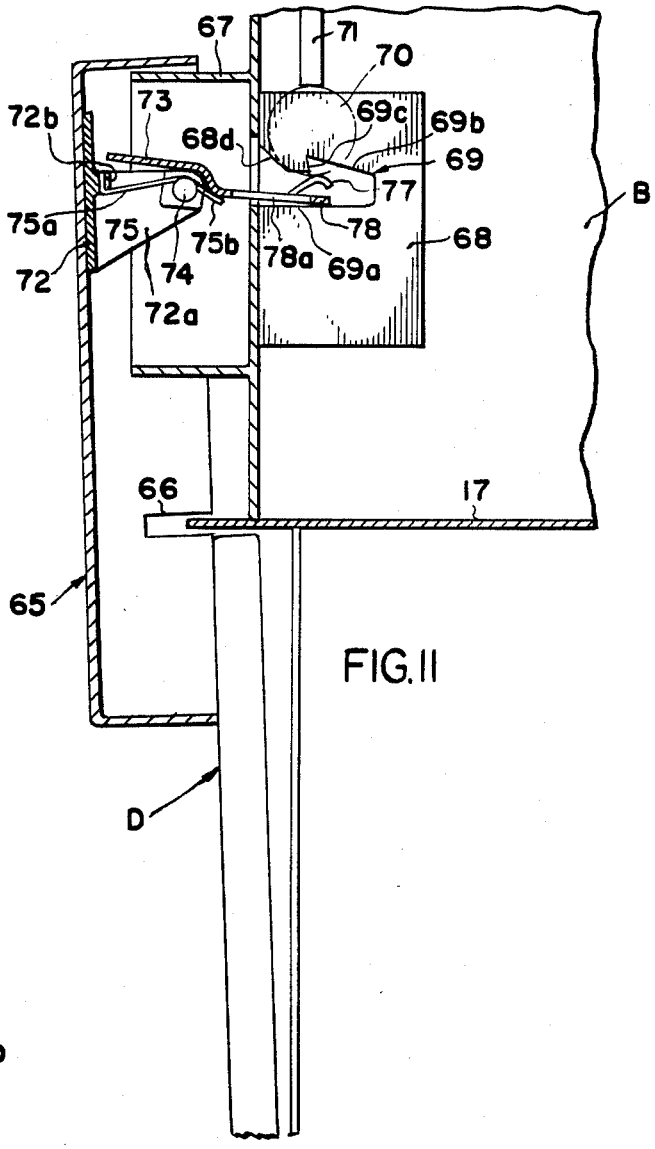
FIG. 11 is a similar view showing the access door in the act of opening with a coin in a position which permits the locking parts to disenaage so that the access door can be swung to open position.
Figure 12:
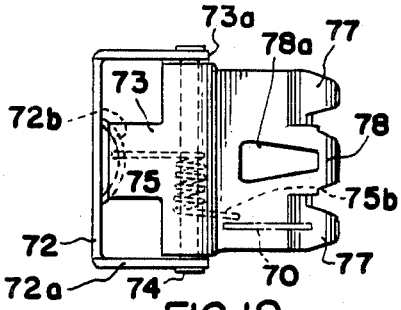
FIG. 12 is a top plan view of the latch plate which is mounted on the access door.

Referring now more particularly to FIGS. 10 and 11, We have illustrated conventional door-locking mechanism, and it is to be understood that various door-locking mechanisms of a conventional nature such as shown, for example, in the following U.S. Pat. Nos. 4,037,701; 2,984,326; 3,174,608; 3,125,247; 3,265,177; 3,403,765; 3,464,530; 3,738,466; 3,882,984; 3,946,848; and 4,000,799 may be used. For purposes of the present description to disclose only a typical locking mechanism, We have shown the usual coin box B mounted on the top wall 17 of cover L. Fixed to the upper end of door D is a latching extension box generally designated 65 which includes outer wall 65*a* and side walls 65*b*. It will be observed that slots 66 are cut in the side walls 65*b* to receive the extending front edge of the wall 17 when the door D is in locked position (see FIG. 10).

Mounted on the front of the coin box B to fit within the panel 65 when the door D is in locked position, is a box-like projection 67. Coin box B also mounts the usual lock plate 68 which includes the locking recess 69 which is open at the front of plate 68. Locking recess 69 has a lower marginal wall 69*a*, an upper ramp wall 69*b*, and vertical lock wall portion 69*c*. Provision is made within the coin box mechanism B for channeling a coin 70, shown in chain lines, to a position in which the usual abutment member 71 holds the coin 70 during the unlocking operation. Afterward the coin 70 is moved to the coin receptacle in the usual manner.

Provided on the interior of the housing 65 is bracket 72 fixed to the walls 65*a*, and pivotally mounted on bracket 72 is latch plate 73. The latch plate 73 has dependent ears 73*a*, which are rotatably received on a pin 74 mounted by the inwardly projecting portions 72*a* of plate 72. A torsion spring 75 has an arm 75*a* which hooks under a retainer wall 72*b* provided on bracket 72, and an extending arm 75*b* which bears on the forwardly projecting end of plate 73 and normally maintains it in the up position in which it is shown in FIG. 10.

Provided on the front end of the latch 73 are a pair of spaced apart upwardly bent cam ears 77 which are in position to be vertically aligned with a pair of coin chutes, one of which may be used for daily papers and the other for Sunday papers, for instance. Intermediate the ears 77 is an opening 78*a* which defines a latch bar 78 formed in the latch 73. When the door D is in the extreme closed position, the parts are in the FIG. 10 location. Assuming that coin 70 is fed down into position over one of the camming ears 77, and door D is attempted to be swung outwardly, wall 78 is forced upwardly by the spring 75 to ride forwardly along ramp surface 69. It can go only until it engages vertical lock surface 69*c*. If, however, a coin 70 is inserted to the position shown when door D is moved outwardly by the customer, latch 73 is forced downwardly because coin 70 pushes one of the camming ears 77 downwardly, and the lock wall 78 can be moved beyond the lock surface 69*c*. When the door D is returned by springs 21 to closed position, latch plate 73 automatically is relatched, latch bar 78 engaging a cam surface 68*d* on plate 68 and being forced downwardly to assume the FIG. 10 position. The unlatching operation described is conventional, and need not be further illustrated or described.

THE OPERATION

Figure 4:
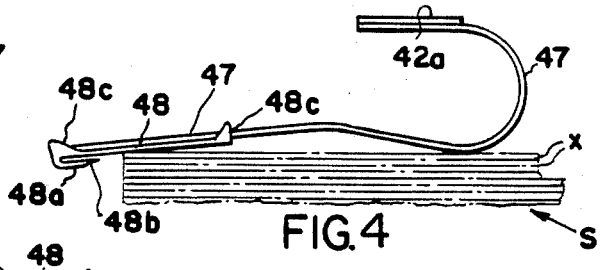
FIG. 4 is a fragmentary, elevational view, taken on the line 4—4 of FIG. 3 and showing the dispensing claw in its "ready" position, prior to the time the access door has been unlatched and swung outwardly to operate the dispensing claw.
Figure 5:
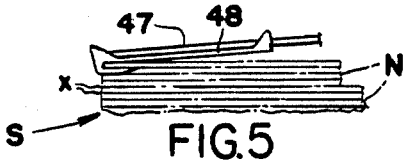
FIG. 5 is a similar, fragmentary view showing the dispensing claw in a position in which it has engaged in the end of the top-most newspaper in the stack.

In operation, and assuming that the coin 70 is in the position shown and door D will delatch when it is swung outwardly, it is to be understood that the parts are in the FIGS. 3 and 4 "ready" position in which plate 60 is cammed upwardly. As the door D is opened, and cable 55*b* is moved to the 55' position shown in chain lines in FIG. 1, drive plate 54 is swung counterclockwisely (FIG. 3) and, because of the engagement of the pin 59 with the marginal wall of slot 58, the claw mounting plate 42*a* will also be moved counterclockwisely. Claw hook 48*a* will be moved from the FIG. 4 position to the FIG. 5 position, and enter in between the folds of the topmost newspaper N in the stack S. As the plates 42 and 54 move counterclockwisely, the cam lug 63 will be removed from the latch extension 60*b* so that latch plate 60 immediately swings down to the FIG. 8 position, ready for the part which it must play in delaying the movement of the claw C on the return of the door D.

The various positions of the claw C and the topmost newspaper during counterclockwise movement of plates 54 and 42 are disclosed in FIG. 3 and have previously been mentioned. When the door D has been swung to the horizontal position in which it is shown in chain lines at D' in FIG. 1, the newspaper will have been swung to or past the N" position in which it is shown in FIG. 3, and will be in a position of projection out the opening O so that it can be grasped by the customer and pulled out the remainder of the way.

Figure 6:
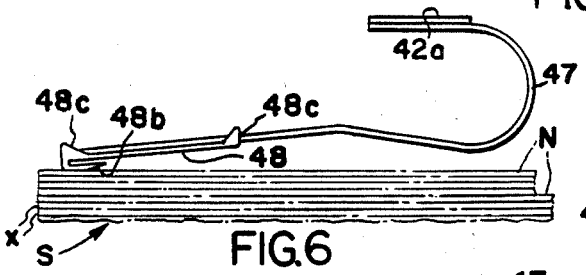
FIG. 6 is a view similar to FIGS. 4 and 5, showing the claw in a position in which it is momentarily halted on the return of the access door, in order to permit the access door to be locked before the dispensing claw is moved over to the FIG. 4 "ready" position.

When the customer then releases door D, the torsion springs 100 on the hinge pins 18 cause the door to be swung inwardly thus moving cable 55*b* in a direction to cause plate 54 to be driven in the clockwise direction. The return spring 50 will, at the same time, cause plate 42 to move in unison with the plate 54. This movement clockwisely in unison continues until post 59 on the plate 42 comes into engagement with the lug 60*a*, which is in the FIG. 8 position as previously indicated. At this point, further clockwise movement of the claw mounting plate 42 is arrested by the latch 60, while the drive plate 54 can continue to move clockwisely because recess 58 can move relative to pin 59 to the FIG. 9 position of the parts. The purpose of arresting the movement of plate 42 and claw C so that the claw C is at rest for a short time in the FIG. 6 position is so that door D can be latched in position before the claw C is permitted to snap clockwisely over to the dispensing position.

If the door D were not locked before the claw C reached the lowered FIG. 4 position in which it could dispense another paper, it would be possible for a customer to move the door to almost closed position, and then swing it downwardly again and dispense a second newspaper without having paid for it. After the short time delay provided by the relative clockwise movement of drive plate 54 when plate 42 remains stationary, cam 63 has moved with plate 54 to a position where it engages the projection 60*b* on latch plate 60. Further movement of plate 54 clockwisely will cause the plate 60 to be cammed upwardly to the FIG. 2 position against the force exerted by torsion spring 62, at which time plate 42 will be abruptly released to snap further clockwisely because of the contraction of spring 50 to normal position. Claw C thus moves almost instantaneously (at a time when door lock latch 73 has moved its latch bar 78 beyond vertical wall 69*c*) from the FIG. 6 position over to the FIG. 4 position.

To support the cover L in open position when desired, so that a stack of newspapers a may be loaded to the elevator platform E, a brace bar 76 is supported by a crossbar 77 provided on the cover L. The brace bar 76 is adated to be received by an enlarged sleeve 78 fixed to the housing rear wall 11. A turned up lower end 76*a* of bar 76 engages under the sleeve 78 to prevent the cover from being swung upwardly beyond a vertical position.

What is claimed is:

1. In a coin operated newspaper and like article vending machine for dispensing newspapers and like articles on a one-at-a-time basis:

a. a housing forming a cabinet for containing newspapers and like articles to be vended;
b. a door hinged on one side of the cabinet;
c. coin operated lock mechanism for automatically releasably locking the door to the cabinet when the door is swung shut;
d. partition means incorporated with the housing as a wall thereof situated behind the door and providing a dispensing slot behind the door for passing one article at a time;
e. elevator mechanism for assuring the delivery of newspapers successively to a location opposite the dispensing slot;
f. newspaper dispensing elements actuable to engage and move the newspaper partly out the opening;
g. linkage mechanism connecting the door and dispensing elements, operable when the door is swung open, to move the newspaper at least partly out of the opening;
h. members incorporated with the linkage mechanism and dispensing elements for preventing return movement of the newspaper dispensing elements to dispensing position prior to locking of the door via the lock mechanism; and
i. means operating independently of the closing movement of the door for moving the dispensing elements to dispensing position after the door is swung shut and locked.

2. The machine of claim 1 wherein spring means is connected to return the door to closed position when it is released by the customer.

3. The machine of claim 1 wherein said members for preventing return of the dispensing elements comprise lost motion mechanism permitting return of the door to locked position before the dispensing elements reach full return position.

4. In a coin operated newspaper and like article vending machine for dispensing newspapers and like articles on a one-at-a-time basis:

a. a housing forming a cabinet for containing newspapers and like articles to be vended;
b. a door hinged on one side of the cabinet;
c. coin operated lock mechanism for automatically releasably locking the door to the cabinet when the door is swung shut;
d. partition means incorporated with the housing as a wall thereof situated behind the door and providing a dispensing slot behind the door for passing one article at a time;
e. elevator mechanism for assuring the delivery of newspapers successively to a location opposite the dispensing slot;
f. newspaper dispensing elements actuable to engage and move the newspaper partly out the opening;
g. linkage mechanism connecting the door and dispensing elements, operable when the door is swung open, to move the newspaper at least partly out of the opening;
h. members incorporated with the linkage mechanism and dispensing elements for preventing return movement of the newspaper dispensing elements to dispensing position prior to locking of the door via the lock mechanism;
i. means for moving the dispensing elements to dispensing position after the door is swung shut and locked;
j. said dispensing mechanism comprising a pair of pivotally mounted plates, one plate mounting a claw for engaging the edge of a newspaper and the other plate being connected to said linkage mechanism to function as a drive plate;
k. means mounting said plates for relative and conjoint rotation on said housing;
l. said members for preventing return movement of the dispensing elements including lost motion mechanism comprising a pin and slot connection provided for said plates whereby said drive plate normally rotates said one plate; and
m. means arresting movement of said one plate so that the drive plate does not move it but moves relative to it when the door has neared a position in which it will be locked on its return.

5. The machine of claim 4 wherein spring means is connected to said claw mounting plate to normally urge the claw to a full return position beyond the edge of the next newspaper to be dispensed and in position to engage it; and said arresting means comprises a latch, pivotally mounted by said housing, which is normally urged from remote position to a position in the path of pivotal movement of the claw mounting plate to stop its movement when the claw mounting plate reaches a certain position of return movement; and cam means on the drive plate is mounted to engage said latch after a predetermined relative movement of the drive plate relative to the arrested claw mounting plate and move the latch to remote position so that said spring means can power the claw mounting plate to full return position.

6. The machine of claim 5 wherein said housing includes a top lid hingedly connected to swing upwardly, and said plates and latch are mounted thereon.

7. The machine of claim 6 wherein said linkage mechanism includes a cable connected between said door and drive plate, and sheath means for the cable supported by the housing such that swinging of the door in either opening or closing movement pivots said drive plate.

8. The machine of claim 4 wherein a leaf spring connects said claw and one plate, and normally suspends said claw at a level below the upper surface of a newspaper in dispensing position opposite an end of the newspaper.

9. The machine of claim 8 wherein a leaf spring mounted on said lid normally supports a castering roller opposite the dispensing position of said claw in a position to engage the one corner of the newspaper to be dispensed and hold it down so that it does not interfere.

10. The machine of claim 4 wherein said one plate also mounts a castering roller positioned to engage one corner of the topmost newspaper to act as a fulcrum about which the claw pivots said newspaper to move it out said slot.

11. The machine of claim 1 wherein said mechanism for assuring the delivery of a newspaper to a location opposite the slot comprises a horizontally disposed elevator platform on which a stack of newspapers is placed, and resilient means for urging the platform upwardly to a position in which the topmost newspaper is opposite the slot.

12. The machine of claim 1 wherein means is provided for operating said lock mechanism as the door is swung shut and said dispensing elements ride along the next successive paper but do not move beyond it to dispensing position until said lock operating mechanism is operated.

13. In a coin operated newspaper and like article vending machine for dispensing articles on a one-at-a-time basis:

a. a housing forming a cabinet for containing newspapers and like articles to be vended;

b. a door hinged on one side of the cabinet;

c. coin operated lock mechanism automatically reengageable to lock the door as the door is returned to closed position;

d. partition means incorporated with the housing as a wall thereof situated behind the door and providing a dispensing slot behind the door for passing one article at a time;

e. mechanism for assuring the delivery of newspaper successively to a location opposite the dispensing slot;

f. newspaper dispensing elements movable in an arcuate path of travel in a generally horizontal plane actuable to engage and pivotally move the newspaper through an angle approaching 90 degrees to a position partly out the opening;

g. linkage mechanism connecting the door and dispensing elements, operable when the door is swung, to move the newspaper at least partly out of the opening and to move the dispensing elements in the return direction with closing of the door; and h. means for delaying return of the dispensing elements to dispensing position pending return of the door to closed position to prevent the next successive paper from being dispensed before the lock mechanism is reengaged.

14. A method of converting newspaper and like article dispensing machines comprising housings with access doors in a side wall thereof which can be moved to open position, and coin operated locking mechanisms which automatically latch when the door is moved to closed position, and which can be unlatched when proper coins are fed to the locking mechanisms, including the steps of:

a. biasing an elevator platform within the housing opposite the access door to support a stack of newspapers such that the topmost is at a predetermined level;

b. partitioning the space behind the door off from access via the door except for a dispensing slot of a size to dispense a single newspaper from the upper end of the housing at said level;

c. engaging the topmost newspaper with a dispenser connected with the access door such that movement of the door will move the dispenser from dispensing position in a path of travel to drive the newspaper partly out of said slot to a position where it can be grasped and pulled the rest of the way out by the customer;

d. moving the access door in a return direction to move the dispenser in a return direction; and e. delaying return movement of the dispenser in its path of return movement with the access door, before the door reaches closed position, so that the access door reaches closed position before the dispenser reaches dispensing position.

15. A method of dispensing a newspaper or like article from a housing having an access door in a side wall thereof which can be moved to open position, a partition behind the door providing a dispensing slot near its upper end, an elevator including a platform for supporting a stack of horizontally disposed newspapers with the uppermost opposite said slot, a dispenser for engaging the topmost newspaper connected with said access door such as to drive the newspaper partly out of the slot when the door is moved toward open position, and a coin operated latch which automatically latches the door when the door is moved to closed position, and which can be unlatched when proper coins are inserted; comprising the steps of:

a. by moving the door to open position, moving the dispenser in an arcuate path of travel in a generally horizontal plane to pivot the newspaper through an angle approaching 90 degrees;

b. pulling the newspaper from the slot; and c. restoring the door to closed position and latching the door once again in latched position, movement of the dispenser in the return direction upon restoration of the door to closed position being delayed pending latching of the door.

16. In a coin operated newspaper and like article vending machine for dispensing newspapers and like articles on a one-at-a-time basis:

a. a housing forming a cabinet for containing newspapers and like articles to be vended;
b. a door hinged on one side of the cabinet;
c. coin operated lock mechanism for automatically releasably locking the door to the cabinet when the door is swung shut;
d. partition means incorporated with the housing as a wall thereof situated behind the door and providing a dispensing slot behind the door for passing one article at a time;
e. elevator mechanism for assuring the delivery of newspapers successively to a location opposite the dispensing slot;
f. newspaper dispensing elements actuable to engage and move the newspaper partly out the opening;
g. linkage mechanism connecting the door and dispensing elements, operable when the door is swung open, to move the newspaper at least partly out of the opening;
h. members incorporated with the linkage mechanism and dispensing elements for preventing return movement of the newspaper dispensing elements to dispensing position prior to locking of the door via the lock mechanism;
i. means operating independently of the closing movement of the door for moving the dispensing elements to dispensing position after the door is swung shut and locked;
j. said newspaper dispensing element comprising a claw suspended from a leaf spring;
k. a pivotally mounted lever supported by said housing and moved through a path of rotation to cause the claw to engage the end of a newspaper and pivot it through an arc approaching 90 degrees to a position in which its end is accessible through said slot; and
l. said leaf spring normally supporting said calw such that it bears against the topmost newspaper in the return travel of said claw and then falls to a position below the upper surface of the topmost newspaper to engage an end fold of the newspaper when it clears the newspaer on its movement to return dispensing position.

17. The method of claim 14 wherein the dispensing element rides along the next successive paper during return movement of the access door but does not move beyond it to dispensing position until the access door is swung to closed position.

18. In a coin operated newspaper and like article vending machine for dispensing articles on a one-at-a-time basis:
a. a housing forming a cabinet for containing newspaprs and like articles to be vended;
b. a door hinged on one side of the cabinet;
c. coin operated lock mechanism automatically reengageable to lock the door as the door is returned to closed position;
d. partition means incorporated with the housing as a wall thereof situated behind the door and providing a dispensing slot behind the door for passing one article at a time;
e. mechanism for assuring the delivery of newspaper successively to a location opposite the dispensing slot;
f. newspaper dispensing elements movable in an arcuate path of travel in a generally horizontal plane actuable to engage and pivotally move the newspaper through an angle approaching 90 degrees to a position partly out the opening;
g. linkage mechanism connecting the door and dispensing elements, operable when the door is swung, to move the newspaper at least partly out of the opening and to move the dispensing elements in the return direction with closing of the door; and
h. delay means incorporated with said linkage mechanism and dispensing elements for disrupting return travel of the dispensing elements with said door before the door reaches closed latching position and permitting further return movement of the dispensing elements to dispensing position only after the door has reached latching position.

19. The machine of claim 18 wherein said means for delaying return of the dispensing elements comprises lost motion mechanism for halting the return travel of the dispensing elements for a time while the door continues to move to closed position.

20. The machine of claim 19 wherein means energized by the travel of the door to open position moves said dispensing elements to dispensing position once the door is moved to closed position.

21. In a coin operated newspaper and like article vending machine for dispensing articles on a one-at-a-time basis:
a. a housing forming a cabinet for containing newspapers and like articles to be vended;
b. an actuator movable on the housing between a start position and a newspaper dispensed position;
c. coin operated lock mechanism automatically reengageable to releasably lock the actuator as the actuator is returned to the start position;
d. wall means incorporated with the housing providing a dispensing slot for passing one article at a time;
e. mechanism for assuring the delivery of newspapers successively to a location opposite the dispensing slot;
f. newspaper dispensing elements movable in an arcuate path of travel in a generally horizontal plane actuable to engage and pivotally move the newspaper through an angle approaching 90 degrees to a position partly out the opening;
g. linkage mechanism connecting the actuator and dispensing elements, operable when the actuator is moved from the start position, to move a newspaper at least partly out of the opening and to move the dispensing elements in the return direction with return of the actuator from the newspaper dispensing position; and
h. means for delaying return of the dispensing elements to dispensing position pending locking of the actuator to prevent the next successive paper from being dispensed before the lock mechanism is reengaged.

22. In a coin operated newspaper and like article vending machine for dispensing newspapers and like articles on a one-at-a-time basis:
a. a housing forming a cabinet for containing newspapers and like articles to be vended;
b. an actuator movable on the housing between a start and a newspaper dispensed position;
c. coin operated lock mechanism for automatically releasably locking the actuator when the actuator is returned to the start position;

d. wall means incorporated with the housing providing a dispensing slot for passing one article at a time;

e. mechanism for assuring the delivery of newspapers successively to a location opposite the dispensing slot;

f. newspaper dispensing elements actuable in a path of movement to move the newspaper partly out the opening;

g. linkage mechanism connecting the actuator and dispensing elements, operable when the actuator is moved from the start position to the newspaper dispensed position, to move the newspaper at least partly out of the opening, and operable when the actuator is returned to move the dispensing elements in a return direction;

h. members incorporated with the linkage mechanism and dispensing elements for preventing return movement of the newspaper dispensing elements to dispensing position prior to locking of the actuator via the lock mechanism; and i. means operating independently of the return movement of the actuator for moving the dispensing elements to dispensing position after the actuator is moved to the start position and locked.

* * * * *